United States Patent [19]

Saxman

[11] 4,167,980

[45] Sep. 18, 1979

[54] ROCK BORING CUTTER WITH REPLACEABLE CUTTING ELEMENT

[75] Inventor: William C. Saxman, Irving, Tex.

[73] Assignee: Dresser Industries, Inc., Dallas, Tex.

[21] Appl. No.: 895,566

[22] Filed: Apr. 12, 1978

[51] Int. Cl.[2] ..... E21B 9/08

[52] U.S. Cl. ..... 175/374; 407/43; 175/372; 308/8.2

[58] Field of Search ..... 175/374, 375, 344, 336, 175/372, 409, 337, 361, 363, 368, 364, 372; 308/8.2; 407/32, 35, 43, 46, 57

[56] References Cited

U.S. PATENT DOCUMENTS

| | | | |
|---|---|---|---|
| 1,143,275 | 6/1915 | Hughes | 175/373 X |
| 1,678,201 | 7/1928 | Samuelson | 175/393 |
| 2,037,967 | 4/1936 | DeCosta | 175/337 X |
| 3,612,197 | 10/1971 | Motoyama | 175/374 |
| 3,707,315 | 12/1972 | Goodfellow | 308/8.2 |
| 3,982,595 | 9/1976 | Ott | 175/371 |
| 4,040,493 | 8/1977 | Saxman | 175/374 |

*Primary Examiner*—James A. Leppink
*Assistant Examiner*—Richard E. Favreau
*Attorney, Agent, or Firm*—Eddie E. Scott

[57] ABSTRACT

A cutter with a replaceable cutting element is adapted to be mounted upon the rotary head of an earth boring machine or upon the body of an earth boring bit. A rolling cutter shell is mounted upon the rotary head or the bit for rotary motion to roll along the formations being cut. The rolling cutter shell includes first and second ends with an annular receiving surface between the ends. Replaceable cutting means substantially encircle the rolling cutter shell for contacting the formations and forming a hole therein. The replaceable cutting means include an inner surface that mates with the annular receiving surface of the rolling cutter shell. Locking means securely lock the replaceable cutting means to said rolling cutter shell and draw the inner surface of the replaceable cutting means into engagement with the annular receiving surface of the rolling cutter shell.

1 Claim, 3 Drawing Figures

ROCK BORING CUTTER WITH REPLACEABLE CUTTING ELEMENT

BACKGROUND OF THE INVENTION

The present invention relates to the art of earth boring and more particularly to an earth boring cutter with a replaceable cutting element.

Conventionally, rotary drilling apparatus and particularly rotary drilling apparatus for boring large diameter holes and tunnels includes a multiplicity of roller cutters. A number of the roller cutters together with their bearings and the saddles in which the cutters and bearings are mounted are positioned on a rotary head or a bit body and used to form holes in the formation being bored. The roller cutters may be conveniently mounted on the rotary cutting head of a tunneling machine or on the body of a raise bit. The cutters may be disc type cutters or full face cutters.

A disc type roller cutter is effective in very soft to medium formations. The disc is usually a heat treated alloy steel cutter with an included angle between about 60° and 90°. The disc cutters are usually indexed two or three inches apart. In effect, the disc cutters plow concentric circles around the face of the formation being bored. The cutting discs are indexed so that the formation between discs will break out completely under a given load and R.P.M. This is a very efficient way to cut formations because the cuttings come off the face in relatively large pieces. Disc cutters are not economical in harder formations because the discs dull out quickly in the harder abrasive formations. This is especially detrimental in shaft drilling or raise drilling operations where trip time is costly. It is not practical to make the discs completely of carbide and the brazing on of continuous sintered carbide tips or wedges is also of questionable feasibility from an economical and operational standpoint. Since the bearing life of the roller cutters long outlasts the life of the cutting structure, the cutting structure should be replaced periodically thereby extending the useful lifetime of the cutter. Replacement should be easily possible in the field.

DESCRIPTION OF PRIOR ART

A general indication of the nature of the prior art relating to roller cutters may be obtained from a consideration of the disclosures in the U.S. patents described below.

In U.S. Pat. No. 3,139,148 to J. S. Robbins, patented June 30, 1964, a rotary boring head having roller cutter discs is shown. A plurality of roller cutter discs are mounted on a support plate adapted to rotate about a horizontal axis.

In U.S. Pat. No. 3,216,513 to R. J. Robbins, et al, patented Nov. 9, 1965, cutter assemblies for rock drilling are shown. The cutter assemblies comprise a rotary cutting wheel having a peripheral cutting portion, mounting means including anti-friction bearings on which the cutting wheel is freely rotatable and resiliently cushioned metal-to-metal seal means outboard of the bearings.

In U.S. Pat. No. 2,766,977 to J. S. Robbins, patented Oct. 16, 1965, a rotary cutter head for boring type continuous mining machines is shown. The cutter head includes a plurality of integrally connected wheels or rollers which cooperate with each other to effect a plurality of cutting and breaking actions against adjacent cores causing the cores to break easily and continuously thereby allowing rapid and continuous advance of the boring machine.

In U.S. Pat. No. 3,444,939 to K. G. Bechem, patented May 20, 1969, a cutting roller for roller type enlarging bits is shown. The cutting roller projects through an opening in a shield. The shield is conical and the cutting ribs of the roller make contact with the rock to be cut along lines generally parallel to the shield face.

In U.S. Pat. No. 3,572,452 to D. F. Winberg, patented Mar. 30, 1971, a rolling cutter and seal therefor are shown. The cutter includes at least one bit having an encircling ring or an O-ring base. The bits have a cutting edge formed by two flat surfaces. The flat surfaces may be considered to be planes that rise to an edge. The bits are pressed into circular grooves in the rolling cutter body.

In U.S. Pat. No. 3,596,724 to K. G. Bechem, patented Aug. 3, 1971, a cutting roller is shown. The cutting roller has two circumferentially extending parallel cutting ribs. Each rib is provided with a series of wear resistant exchangeable inserts which protect the crown and flank surface of the rib against wear.

The use of replaceable cutting elements in the related drill bit art is known and a representative indication of this art may be obtained from a consideration of the disclosures of the patents.

In U.S. Pat. No. 4,040,493 to W. C. Saxman patented Aug. 9, 1977, a cutter with a replaceable cutting element is adapted to be mounted upon the rotary head of an earth boring machine or upon the body of an earth boring bit. The cutter is used in conjunction with an earth boring machine that functions to form a borehole or tunnel in the formation being bored. The cutter may operate to fracture rock between a proximate pair of kerfs in a manner to cause fragments of the formation to be separated from the formation being bored or may crush and disintegrate the formation. At least one annular cutting element is mounted on the periphery of the cutter body for contacting the formations. The cutter body includes an external annular threaded surface between the ends of the cutter body. The cutting element includes a threaded inner surface that mates with the threads on the cutter body. A locking shoulder on the cutter body is in contact with a locking shoulder on the cutting element.

In U.S. Pat. No. 3,612,197 to Hiroyasu Motoyama patented Oct. 12, 1971, an improved large diameter hole drilling bit is shown consisting of a cutter head with a plurality of yokes fixedly mounted on the cutter head and a like plurality of roller cutters each rotatably mounted on a yoke. The drilling bit is adapted to be supported by a drilling rod which is rotated by a power unit of the drilling machine. During drilling operation, the cutter head is rotated about the axis of the drilling bit and at the same time the roller cutters are rotated about their own axes with respect to the yokes by contact to the rock or the like. Each roller cutter includes a load pin supported by the yoke fixed on the cutter head, a cutter cone having cutting teeth or individually replaceable tips thereon and bearing balls and/or rollers interposed between the cutter cone and the load pin so that the cutter cone is supported for free rotation on the load pin. Pressure responsive seals and dust filters prevent foreign material from passing into the bearings. The load pin, cutter cone and bearing are preferably held in permanent assembly.

In U.S. Pat. No. 3,204,710 to K. G. Bechem, patented Sept. 7, 1965, an enlarging roller cutter is shown. According to the invention there is provided an enlarging roller cutter with one annular tooth disposed on a roller base member, characterized in that the annular tooth is disposed at the forward free end of a roller base member, and a free surface is left behind the said annular tooth, said cutter being designed to widening or enlarging a previously drilled or pilot hole.

In U.S. Pat. No. 3,426,860 to G. A. Petersen, patented Feb. 11, 1969, a pilot bit with replaceable teeth is shown. The bit body contains a plurality of tooth holding sockets, a plurality of removable teeth and retainers for holding the teeth in the sockets.

In U.S. Pat. No. 1,678,201 to J. P. Samuelson, patented July 24, 1928, a rotary drill bit is shown. The bit includes a cutting element which is formed of identical segments having elongated slots to accommodate bolts and permit the segments to be adjusted or replaced.

In U.S. Pat. No. 1,143,275 to H. R. Hughes, patented June 15, 1915, a demountable cutting edge for drilling tools is shown. The cutting edge consists of a cutting or shearing blade in the form of a ring having its outer periphery formed with a knife edge. Set screws hold the cutting or shearing blade in place.

SUMMARY OF THE INVENTION

The present invention provides a cutter for an earth boring system that has a rotary unit which bores into earth formations to form a hole therein. The rotary unit functions to fracture rock from the formations being bored. The cutter of the present invention is connected to the rotary unit and adapted to contact the formations. A replaceable cutting element is provided which is easily changed at the job site with conventional hand tools. The use of expensive and time consuming methods of conventional cutting structure replacement is eliminated. The aforementioned advantages of the present invention and other features and advantages will become apparent from a consideration of the following detailed description of the invention when taken in conjunction with the drawings.

DETAILED DESCRIPTION OF THE INVENTION

An earth boring cutter is disclosed that will operate as a unitized assembly until cutting structure replacement is necessary. At that time the worn cutting structure is simply removed, and replaced with a new cutting element. This is accomplished with simple hand tools. The replaceable cutting structure may be constructed from steel or other abrasion resistant material, such as tungsten carbide, or any combination of such materials. The cutting structure geometry may vary to accommodate different degrees of boring difficulty. The replaceable cutting structure utilizes a tapered connection between the mating surfaces of the elements. The surfaces are properly stressed by means of axial preload threaded bolts. The torsional loads encountered during operation are carried by the induced presssures in the mating tapered surfaces and in one embodiment of the invention by dowel pins between the elements. The worn cutting element is removed by disconnecting the preload bolts and freeing the worn cutting element.

Figure 1:
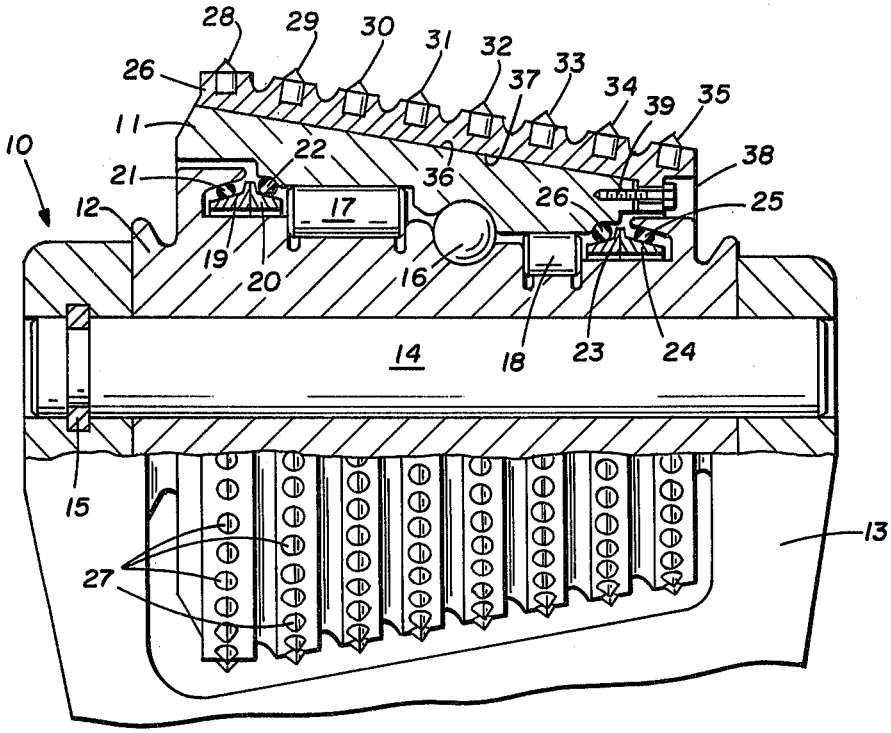
FIG. 1 is an illustration of a cutter constructed in accordance with the present invention positioned in a saddle that is adapted to be connected to a rotary unit of an earth boring system.

Referring now to the drawings and FIG. 1 in particular, a cutter constructed in accordance with the present invention and generally designated by the reference numeral 10 is illustrated. The cutter 10 includes a rolling cutter shell 11 positioned around a bearing shell 12 with bearing shell 12 being securely locked in a saddle mount 13. The saddle mount 13 may be connected to the rotary head of an earth boring machine or to the body of a bit for boring a large diameter hole. The bearing shell 12 is locked in position in the saddle mount 13 by a pin 14 and a retainer element 15. The retainer element is driven through a hole in the saddle mount. The bearing shell 12 remains firmly locked in place throughout the drilling operation due to a tenon and groove arrangement disclosed in U.S. Pat. No. 3,203,492 to C. L. Lichte, patented Aug. 31, 1965.

A multiplicity of bearing systems including a series of ball bearings 16, a series of inner roller bearings 17 and a series of outer roller bearings 18 promote rotation of the cutter shell 11 about the bearing shell 12. Lubricant is retained in the bearing area by two sets of seal elements. The inner set of seal elements includes a pair of annular metal seal rings 19 and 20 that are positioned near the inner end of the cutter 10. A flexible rubber O-ring 21 is positioned between seal ring 19 and the bearing shell 12 to retain the seal ring 19 in the desired position and resiliently urge seal ring 19 against seal ring 20. A flexible rubber O-ring 22 is positioned between the cutter shell 11 and the seal ring 20 to retain the seal ring 20 in the desired position and resiliently urge the seal ring 20 against seal ring 19. The outer set of seal elements includes a pair of annular metal seal rings 23 and 24 that are positioned near the outer end of cutter 10. A flexible O-ring 25 is positioned between the seal ring 24 and bearing shell 12 to retain the seal ring 24 in the desired position and resiliently urge seal ring 24 against seal ring 23. A flexible rubber O-ring 26 is positioned between the cutter shell 11 and seal ring 23 to retain seal ring 23 in the desired position and resiliently urge seal ring 23 against seal ring 24.

The cutter 10 includes a replaceable cutter shell 26 mounted over the rolling cutter shell 11. The replaceable cutter shell 26 will be locked on rolling cutter shell 11 until replacement is required at the end of the cutting structure's service life. At that time, the replaceable cutter shell 26 may be removed by disconnecting it from the rolling cutter shell 11. A new replaceable cutter shell may be inserted in place of the worn replaceable cutter shell 26 and the earth boring operation continued. The replaceable cutter shell 26 includes a multiplicity of carbide inserts arranged to form a series of annular rows 28-35. The individual carbide inserts are designated by the reference number 27. The external surface 36 of the rolling cutter shell 11 is relatively smooth. A shoulder is provided adjacent the external surface 36. The inside surface 37 of the replaceable cutter shell 26 mates with the surface 36 on the rolling cutter shell 11. A shoulder 38 of the replaceable cutter shell 26 is in substantially abutting relationship with the shoulder on rolling cutter 11. The outer surface 36 of the rolling cutter shell 11 slopes in wedge fashion and the inner surface 37 of replaceable cutter shell 26 is of a corresponding shape. The slope of cutter shell 11 and inner surface 37 is at an angle within the range of substantially 2° to substantially 40°. The bolt 39 extends through the shoulder 38 and into the end of rolling cutter shell 11. Tightening of bolt 39 induces a preload into the mating surfaces 36 and 37.

The structural details of cutter 10 having been described, the operation of the cutter 10 will now be considered with reference to FIG. 1. The cutter shells 11 and 26 are adapted to be mounted in the saddle 13 that is affixed to the rotary head (not shown) of an earth boring machine or to the body of a raise bit. The cutting inserts 27 contact the formation and form the desired borehole or tunnel. Should the replaceable cutter shell 26 and cutting structure 27 thereon become worn or damaged before the other elements of the cutter 10 fail, it is desirable to replace the replaceable cutter shell 26. In order to replace the cutter shell 26, the retainer element 14 is removed from saddle mount 13. The bearing shell 12 and cutter shells 11 and 26 are removed from the saddle mount 13. The replaceable cutter shell 26 is withdrawn from the rolling cutter shell 11. In order to remove the worn cutter shell 26, the preload bolts are unthreaded to free the worn cutting element. Some tapping with a sledge may be required. A new replaceable cutter shell is placed on the rolling cutter shell 11. The cutter shells 11 and 26 and bearing shell 12 are again inserted in the saddle mount 13. The pin 14 and the retainer 15 are repositioned in the saddle mount 13 to lock the cutter in place. The cutter 10 is ready for continued operation.

Figure 2:
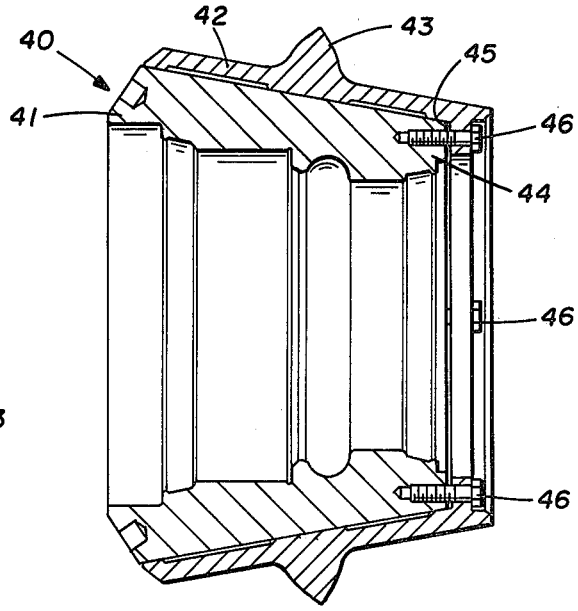
FIG. 2 is an illustration of another embodiment of the cutter of the present invention.

Referring now to FIG. 2 another embodiment of a cutter constructed in accordance with the present invention is illustrated. The cutter 40 includes a rolling cutter shell 41 adapted to be positioned around a bearing shell. The bearing shell will be securely locked in a saddle mount. The saddle mount may be connected to the rotary head of an earth boring machine or to the body of a bit for boring a large diameter hole. The bearing shell remains firmly locked in place throughout the drilling operation due to a tenon and groove arrangement disclosed in U.S. Pat. No. 3,203,492 to C. L. Lichte, patented Aug. 31, 1965. A multiplicity of bearing systems promote rotation of the cutter shell 41 about the bearing shell. Lubricant is retained in the bearing area by seal elements.

The cutter 40 includes a replaceable cutter shell 42 mounted over the rolling cutter shell 41. The replaceable cutter shell 42 will be locked on rolling cutter shell 41 until replacement is required at the end of the cutting structure's service life. At that time, the replaceable cutter shell 42 may be removed by disconnecting it from the rolling cutter shell 41. A new replaceable cutter shell may be inserted in place of the worn replaceable cutter shell 42 and the earth boring operation continued. The replaceable cutter shell 42 includes an annular disc element 43. The external surface of the rolling cutter shell 41 is relatively smooth. A shoulder 44 is provided adjacent the external surface. The inside surface of the replaceable cutter shell 42 mates with the surface on the rolling cutter shell 41. A shoulder 45 of the replaceable cutter opposes the shoulder 44 on rolling cutter 41. The outer surface of the rolling cutter shell 41 slopes in wedge fashion and the inner surface of replaceable cutter shell 42 is of a corresponding shape. The bolts 46 extend through the shoulder 44 and into the end of rolling cutter shell 41. Tightening of bolts 46 induces a preload into the mating surfaces of the rolling cutter shell 41 and replaceable cutter shell 42.

The structural details of cutter 40 having been described, the operation of the cutter 40 will now be considered with reference to FIG. 2. The cutter shell 41 is adapted to be mounted in a saddle that is affixed to a rotary head of an earth boring machine or to the body of a raise bit. The cutting disc 43 contacts the formation and forms the desired borehole or tunnel. Should the replaceable cutter shell 42 and cutting structure 43 thereon become worn or damaged before the other elements of the cutter 40 fail, it is desirable to replace the replaceable cutter shell 42. In order to replace the cutter shell 42, the rolling cutter shell 41 is removed from saddle mount. The replaceable cutter shell 42 is withdrawn from the rolling cutter shell 41. In order to remove the worn cutter shell 42, the preload bolts 46 are unthreaded to free the worn cutting element. Some tapping with a sledge may be required. A new replaceable cutter shell is placed on the rolling cutter shell 41. The cutter shells 41 and 42 are again inserted in the saddle mount. The cutter 40 is ready for continued operation.

Figure 3:
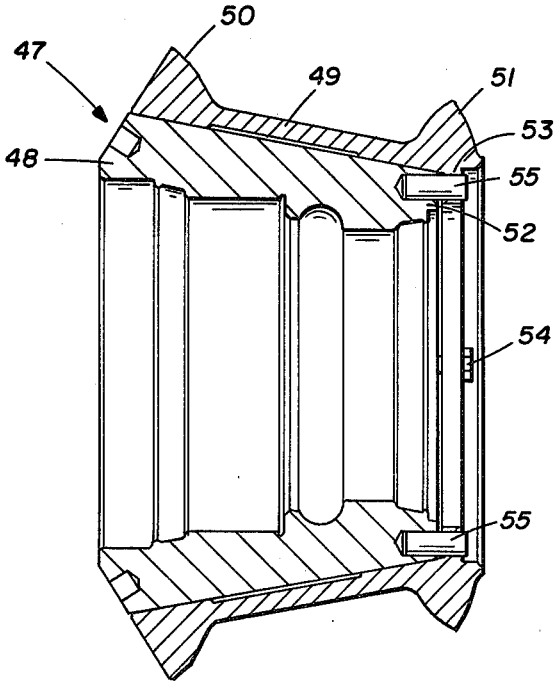
FIG. 3 is an illustration of yet another embodiment of the cutter of the present invention.

Referring now to FIG. 3 another embodiment of a cutter constructed in accordance with the present invention is illustrated. The cutter 47 includes a rolling cutter shell 48 adapted to be positioned around a bearing shell. The bearing shell will be securely locked in a saddle mount. The saddle mount may be connected to the rotary head of an earth boring machine or to the body of a bit for boring a large diameter hole. The bearing shell remains firmly locked in place throughout the drilling operation due to a tenon and groove arrangement disclosed in U.S. Pat. No. 3,203,492 to C. L. Lichte, patented Aug. 31, 1965. A multiplicity of bearing systems promote rotation of the cutter shell 48 about the bearing shell. Lubricant is retained in the bearing area by seal elements.

The cutter 47 includes a replaceable cutter shell 49 mounted over the rolling cutter shell 48. The replaceable cutter shell 49 will be locked on rolling cutter shell 48 until replacement is required at the end of the cutting structure's service life. At that time, the replaceable cutter shell 49 may be removed by disconnecting it from the rolling cutter shell 48. A new replaceable cutter shell may be inserted in place of the worn replaceable cutter shell 49 and the earth boring operation continued. The replaceable cutter shell 49 includes a pair of annular disc elements 50 and 51. The external surface of the rolling cutter shell 48 is relatively smooth. A shoulder 52 is provided adjacent the external surface. The inside surface of the replaceable cutter shell 49 mates with the surface on the rolling cutter shell 48. A shoulder 53 of the replaceable cutter opposes the shoulder 52 on rolling cutter shell 48. The outer surface of the rolling cutter shell 48 slopes in wedge fashion and the inner surface of replaceable cutter shell 49 is of a corresponding shape. A plurality of bolts 54 extend through the shoulder 53 and into the end of rolling cutter shell 48. Tightening of bolts 54 induces a preload into the mating surfaces of the rolling cutter shell 48 and replaceable cutter shell 49. In addition, a plurality of dowel pins 55 extend through the shoulders 53 and into the end of rolling cutter shell 48. The dowel pins 55 assist in carrying the torsional loads encountered during drilling.

The structural details of cutter 47 having been described, the operation of the cutter 47 will now be considered with reference to FIG. 3. The cutter shell 48 is adapted to be mounted in a saddle that is affixed to a rotary head of an earth boring machine or to the body of a raise bit. The cutting disc elements 50 and 51 contact the formation and form the desired borehole or tunnel. Should the replaceable cutter shell 49 and cutting structure 50 and 51 thereon become worn or damaged before the other elements of the cutter 47 fail, it is desirable to replace the replaceable cutter shell 49. In order to replace the cutter shell 49, the rolling cutter shell 48 is removed from saddle mount. The replaceable cutter shell 49 is withdrawn from the rolling cutter shell 48. In order to remove the worn cutter shell 49, the preload bolts 54 are unthreaded to free the worn cutting element. Some tapping with a sledge may be required. A new replaceable cutter shell is placed on the rolling cutter shell 48. The cutter shells 48 and 49 are again inserted in the saddle mount. The cutter 47 is ready for continued operation.

The embodiments of an invention in which an exclusive property or privilege is claimed are defined as follows:

1. A rolling cutter unit for the rotary head of an earth boring system that functions to form a passage through earth formations, comprising:

a saddle mounted upon said rotary head, said saddle having a pair of support arms;

a rolling cutter shell mounted for rotation between said arms, said rolling cutter shell having first and second end portions and a tapered annular external surface between said first and second end portions, said tapered annular external surface having a slope at an angle within the range of substantially 2° to substantially 40°;

a replaceable cutter shell mounted over said rolling cutter shell, said replaceable cutter shell having an annular tapered inner surface that mates with said annular external surface of said rolling cutter shell, said annular tapered inner surface having a slope at an angle within the range of substantially 2° to substantially 40°; and locking means for securely locking said replaceable cutter shell to said rolling cutter shell by drawing said annular tapered inner surface of said replaceable cutter shell onto said tapered annular external surface of said rolling cutter shell thereby inducing a preload into said annular tapered inner surface of said replaceable cutter shell and said tapered annular external surface of said rolling cutter shell, said locking means being a threaded bolt that extends through said replaceable cutting means into said first end portion of said rolling cutter shell.

* * * * *